US008857929B2

(12) United States Patent
Netzer

(10) Patent No.: US 8,857,929 B2
(45) Date of Patent: Oct. 14, 2014

(54) PULL-OUT GUIDE FOR A DRAWER

(75) Inventor: Emanuel Netzer, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/564,043

(22) Filed: Aug. 1, 2012

(65) Prior Publication Data

US 2012/0319548 A1 Dec. 20, 2012

Related U.S. Application Data

(63) Continuation of application No. PCT/AT2011/000053, filed on Feb. 1, 2011.

(30) Foreign Application Priority Data

Feb. 3, 2010 (AT) ..... 148/2010

(51) Int. Cl.
*A47B 88/00* (2006.01)
*A47B 88/04* (2006.01)

(52) U.S. Cl.
CPC ..... *A47B 88/0422* (2013.01); *A47B 88/0418* (2013.01)
USPC ..... 312/334.5; 312/334.4

(58) Field of Classification Search
CPC ..... A47B 88/04; A47B 88/0422; A47B 2210/0054
USPC ..... 312/330.1, 334.1, 334.4, 334.5, 334.6, 312/334.8, 334.27, 334.7, 333
See application file for complete search history.

(56) References Cited

U.S. PATENT DOCUMENTS 4,778,230 A * 10/1988 Lautenschlager ..... 312/334.5
4,810,045 A * 3/1989 Lautenschlager ..... 312/334.5
5,375,922 A * 12/1994 Brustle et al. ..... 312/334.4

(Continued)

FOREIGN PATENT DOCUMENTS

AT 009 114 U1 5/2007
DE 21 23 397 11/1972

(Continued)

OTHER PUBLICATIONS

Machine Translation of WO 2009/056326, May 2009, retrieved from www.epspacenet.com.*

(Continued)

*Primary Examiner* — Daniel Rohrhoff
*Assistant Examiner* — Kimberley S Wright
(74) *Attorney, Agent, or Firm* — Wenderoth, Lind & Ponack, L.L.P.

(57) ABSTRACT

The invention relates to a pull-out guide for a drawer. The pull-out guide has a body rail to be fastened to the furniture body and at least one pull-out rail that can be moved relative to the body rail. The pull-out guide includes a retaining element having a connecting element, so that the drawer can be adjustably connected to the pull-out rail. The retaining element can be connected to the pull-out rail and the connecting element is movably mounted relative to the retaining element. An adjusting device for horizontally moving the connecting element is arranged on the retaining element, and the adjusting device includes a converting device, which can be rotationally moved about an axis arranged substantially parallel to the longitudinal axis of the pull-out rail and so that a rotational motion can be converted into a translational motion.

28 Claims, 16 Drawing Sheets

(56) References Cited

U.S. PATENT DOCUMENTS

| | | | | |
|---|---|---|---|---|
| 5,439,283 | A * | 8/1995 | Schroder et al. | 312/334.4 |
| 5,580,139 | A * | 12/1996 | Grabher | 312/333 |
| 5,588,729 | A * | 12/1996 | Berger | 312/334.4 |
| 6,454,371 | B1 * | 9/2002 | Muterthies et al. | 312/263 |
| 6,913,334 | B2 * | 7/2005 | Weichelt | 312/334.4 |
| 6,945,618 | B2 * | 9/2005 | Kim et al. | 312/334.4 |
| 7,014,282 | B2 * | 3/2006 | Hammerle | 312/334.4 |
| 7,226,139 | B2 * | 6/2007 | Salice | 312/334.4 |
| 7,244,006 | B2 * | 7/2007 | Schwaerzler et al. | 312/334.4 |
| 7,549,712 | B2 * | 6/2009 | Booker et al. | 312/334.6 |
| 7,708,358 | B2 * | 5/2010 | Embacher | 312/333 |
| 7,883,162 | B2 * | 2/2011 | Langguth et al. | 312/319.5 |
| 8,016,374 | B2 * | 9/2011 | Kropf et al. | 312/333 |
| 8,220,884 | B2 * | 7/2012 | Berger | 312/334.4 |
| 8,336,973 | B2 * | 12/2012 | Berger | 312/334.4 |
| 8,424,984 | B2 * | 4/2013 | Ritter | 312/333 |
| 2001/0019235 | A1 | 9/2001 | Hammerle | |
| 2004/0239219 | A1 | 12/2004 | Kim et al. | |
| 2004/0245898 | A1 * | 12/2004 | Amann et al. | 312/334.46 |
| 2007/0103043 | A1 * | 5/2007 | Kropf et al. | 312/334.5 |
| 2008/0218045 | A1 * | 9/2008 | Moser | 312/333 |
| 2008/0247812 | A1 * | 10/2008 | Embacher | 403/231 |
| 2009/0096337 | A1 * | 4/2009 | Langguth et al. | 312/319.8 |
| 2009/0167128 | A1 | 7/2009 | Berger | |
| 2009/0251037 | A1 * | 10/2009 | Berger | 312/334.1 |
| 2011/0204761 | A1 * | 8/2011 | Janzen et al. | 312/334.1 |
| 2012/0080988 | A1 * | 4/2012 | Greussing | 312/334.6 |

FOREIGN PATENT DOCUMENTS

| | | | |
|---|---|---|---|
| DE | 24 22 408 | | 10/1975 |
| DE | 31 38 204 | A1 | 6/1982 |
| DE | 86 27 618.2 | | 11/1986 |
| DE | 20 2006 003 035 | U1 | 7/2007 |
| DE | 20 2007 014 954 | U1 | 12/2008 |
| EP | 1 147 725 | B1 | 8/2003 |
| WO | 2007/096156 | | 8/2007 |
| WO | 209/056326 | | 5/2009 |
| WO | WO 2009/056326 | * | 5/2009 |
| WO | 2010/141964 | | 12/2010 |

OTHER PUBLICATIONS

Translation of WO2009056326, tranlated by Mcelroy Translation Company, Jan. 2013, 22 pages.*

International Search Report issued Apr. 11, 2001 in corresponding Application No. PCT/AT2011/000053.

Austrian Search Report issued Sep. 13, 2010 in corresponding Austrian Application No. AT 148/2010.

* cited by examiner

PULL-OUT GUIDE FOR A DRAWER

This application is a continuation of International Application No. PCT/AT2011/000053, filed Feb. 1, 2011.

BACKGROUND OF THE INVENTION

The invention concerns an extension guide for a drawer comprising a carcass rail to be fixed to the furniture carcass and at least one extension rail displaceable relative to the carcass rail. A holding element has a connecting element with which the drawer can be adjustably connected to the extension rail. The holding element is or can be connected to the extension rail, and the connecting element is mounted movably relative to the holding element. An adjustment device for horizontally moving the connecting element is arranged on the holding element.

EP 1 147 725 B1 discloses a drawer extension guide of the general kind set forth herein, wherein the rearward end of a drawer can be connected to the drawer extension guide without the use of a tool by way of a mounting portion in the form of a holding nose, that is mounted to the extension rail. The holding nose is mounted at the end of the extension guide, that is inward of the furniture carcass, and extends in substantially parallel spaced relationship with the top side thereof. Fitting and removal of the rearward end of the drawer relative to the extension rail is effected by pushing the drawer onto the holding nose or pulling it back therefrom. After fitment has been effected by pushing onto the holding nose, the drawer is secured in its rear end region against being lifted off and laterally displaced. To permit inclination of the front panel of a drawer in the mounting position, without a substantial change in the heightwise position thereof relative to the carcass, EP 1 147 725 B1 proposes making the holding nose displaceable in the heightwise direction.

AT 9 114 U1 discloses a touch-latch extension guide in which an actuating element with an eccentric adjusting wheel serves for depthwise adjustment of the drawer in the furniture carcass along the longitudinal direction of the extension rail. There is no disclosure of displacement in a lateral direction. By virtue of the temporary connection of the extension guide to the locking unit, implemented by the touch-latch mechanism, an actuating element of a different configuration or in a different location is not possible.

Further adjustment options for drawers in relation to extension guides in a lateral direction are disclosed in DE 21 23 397 A1, DE 31 38 204 A1 and DE 24 22 408 A1, wherein such a displacement is ensured by wedge surfaces as between the drawer and the extension guide.

DE 20 2006 003 035 U1 and DE 20 2007 014 954 U1 describe the feature whereby an additional lateral displacement of the drawer relative to the extension rail can also be produced. In that case, a receiving component is fixed to the rear wall of the drawer, which component has a slot-shaped opening for receiving a plate connected to the drawer extension guide. The plate is displaceable by a predetermined amount within the slot-shaped opening, whereby lateral displacement of the rear end region of the drawer is also possible. A further possible way of implementing lateral displacement of the drawer relative to the extension rail is shown in Austrian patent application A 895/2009, in which a holding projection can be fitted into a pre-drilled bore in the drawer. The holding portion mounted to the extension rail can be fitted into the holding projection and is displaceable in a lateral direction within the holding projection.

A similar device for lateral adjustment of a drawer is shown in WO 2007/096156, in which case a holding projection is mounted displaceably in a slot-shaped opening in the holding portion.

Such devices for lateral and heightwise displacement of the drawer relative to the extension rails are necessary to compensate for minor production tolerances in the drawers or the extension guides and to produce a homogeneous appearance in respect of the gaps, in particular if a plurality of drawers are fitted into a furniture carcass.

The above-mentioned possible ways of laterally displacing the drawer relative to the extension rail do not include the possibility of a sensitive adjustment device which can be actively actuated. In the foregoing devices, a respective projection is held in a grooved horizontal opening. By knocking on the drawers or on the holding portion, the projection is displaced in the grooves, and that affords lateral displacement of the drawer relative to the extension guide. Intentional active displacement of the lateral position of the drawer, however, is not possible in that way as the necessary force for acting on the drawer or the holding portion to move from one recess in the grooving into the next one cannot be exactly applied. The existing devices are therefore insensitive and inaccurate in operation.

SUMMARY OF THE INVENTION

The object of the present invention is to avoid the disadvantages of the above-mentioned state of the art, and to afford a possible way with which the lateral position of the drawer relative to an extension rail can be actively adjusted, wherein the desired extent of the lateral displacement can be observed as exactly as possible.

The extension guide according to the invention thus includes a holding element with a connecting element with which the drawer can be adjustably connected to the extension rail. The holding element itself is or can be connected to an extension rail of the extension guide. The extension rail can also be in one piece with a holding element formed thereon. The connecting element is mounted movably relative to the holding element so that a relative movement is made possible between the drawer and the extension rail if the connecting element is connected to the drawer.

According to the invention, an adjustment device for horizontal movement of the connecting element is arranged on the holding element. The movement of the connecting element is transmitted to the drawer by the indirect or direct connection of the connecting element to the drawer. The adjustment device includes an adjustment mechanism with which the extent of the horizontal movement is adjustable, and thus the drawer is actively and sensitively displaceable relative to the extension rail.

The connecting element, for example, can be arranged in the rear wall of the drawer or also in the drawer side wall, for example in the front face thereof which faces into the carcass. The extension guide according to the invention permits mounting and adjustment of a drawer made of wood material, which—as a common component—can be releasably fixed to the extension guide, and can preferably be fitted and/or removed without the use of a tool.

In that respect the adjustment device can be of a self-locking configuration so that after active displacement of the drawer relative to the extension rail in the lateral direction independent further displacement is prevented. That self-locking action can be based for example on a frictional connection between the components of the adjustment device.

It is preferably provided that the holding element is connected to the drawer in the rear region, for example at the rear wall of the drawer, to the drawer. For that purpose, the holding element can be arranged at the rearward end of the extension guide or at one extendible rail of a drawer extension guide, respectively.

The adjustment device includes a rotationally movable transmission device by which a rotational movement component can be converted to a translatory movement of the connecting element. In that case, rotation of the rotationally movable transmission device is about an axis arranged substantially parallel to the longitudinal axis of the extension rail (that is to say, about the longitudinal direction of the extension rail). The transmission device can be, for example, in the form of an adjusting lever or can include an adjusting lever. The adjustment device can permit continuous adjustment of the drawer relative to the extension rail in the lateral direction. Further arrangements are also conceivable with which discrete displacement can be effected.

In an embodiment of the invention, the extension guide includes a central rail which is arranged between the extension rail and the carcass rail and is movable relative to them. Such an extension guide permits full extension of the drawer.

In that case, the transmission device can be pivotally or rotatably mounted to the holding portion or to a fixing portion which is mounted to the drawer. Lateral displacement of the drawer relative to the extension rail always implies a translatory movement. A transmission device with which a rotational movement component can be converted into a translatory movement component affords the advantage that it is possible to make use of lever effects so that a sensitive displacement in an active fashion is possible. In that respect, the adjustment device can be of such a design configuration as to permit continuous or stepwise adjustment of the lateral position of the drawer relative to the extension rail.

In an embodiment, the transmission device is provided with a handle for actuation of the adjustment device, without using a tool. In that way the lateral position of the drawer relative to the extension rail can be easily adjusted.

In addition or alternatively, the transmission device can be provided with a screw, wherein the transmission device can be actuated by rotating the screw.

In order to facilitate adjustment, the transmission device can be at least partially of a lever-shaped or eccentric configuration so that manually only low forces are required to displace even heavy large drawers.

The transmission device can also include an adjusting wheel having a tooth arrangement, or an additional gear which is in engagement with a horizontally arranged tooth arrangement, for example a toothed rack, for lateral displacement of the drawer.

In an embodiment of the invention, the holding element is fixedly connected to the extension rail. For that purpose, abutment surfaces or support elements can be formed on the holding element, which are in engagement in corresponding openings in the extension rail or which are welded to the extension rails. However, a releasable connection between the holding element and the extension rail is also possible.

It is particularly preferably provided that arranged on the holding element is a guide device, by which the connecting element is displaceably guided on the holding element.

In that case, that guide device can have a guide rail which is mounted in the holding element, wherein arranged on the connecting element or the transmission device is a guide sleeve of the guide groove. The guide sleeve at least partially encompasses the guide rail and can be mounted displaceably along the guide rail. In that respect, the profile shape of the guide rail is in principle any desired shape. In a simple fashion the guide rail is in the form of a guide pin. Such a guide arrangement ensures correct stable displacement in the lateral direction.

The guide device can further have an elongated slot arranged in the holding element or a sliding guide arranged in the holding element, into which engages a guide projection or a guide pin of the connecting element. The guide projection or guide pin is mounted displaceably in the slot or in the sliding guide.

The holding element can further have a fixing portion to be fixed to the drawer. In that case, the above-mentioned guide rail as well as the above-mentioned slot or the sliding guide can also be arranged in that fixing portion. The fixing portion can be in the form of a mounting plate.

In a further embodiment of the invention, the connecting element includes a hooked holding nose which engages into openings in the drawer in the mounted condition in which the holding element is connected to the drawer. In that case, the openings can be pre-drilled bores. In the mounted condition, the holding nose can be held with a press fit or with a sliding fit within the openings. The holding nose can have a cylindrical shape or can also have additional latching elements for a more stable connection.

In a further embodiment of the invention, the displacement element includes a mounting plate which can be fixed to the drawer and to which the adjustment device is mounted. If the adjustment device includes a rotationally movable transmission device, it can thus be provided that the transmission device is mounted rotatably or pivotably to the mounting plate. In addition, guide devices for guiding the movement of the displacement element can be arranged in that mounting plate.

In an embodiment of the invention, the extension guide can include an arresting device, by which the adjustment device can be releasably arrested so that further lateral displacement of the drawer relative to the extension rail is prevented.

In a preferred embodiment of the invention, arranged on the holding element is a further adjustment device, with which the drawer can be displaced in a vertical direction relative to the extension rail. In that respect, it is provided that the further adjustment device is actuable independently from the adjustment device for lateral displacement of the drawer. Lateral displacement and heightwise displacement are thus decoupled, thereby giving a maximum degree of adjustment versatility.

Thus, with such a further adjustment device, both heightwise displacement and also lateral displacement independently thereof of the drawer relative to the extension rail is possible.

For that purpose, arranged on the holding element is at least one support bar, on which the drawer or the drawer bottom at least partially rests in the mounted condition. The at least one support bar is movable vertically relative to the extension rail by the further adjustment device. The at least one support bar can be part of the connecting element so that the connecting element is also movable in a vertical direction, and the vertical movement can be performed independently of the horizontal movement on the holding element. The at least one support bar can, however, also be arranged on a holding portion, the holding portion being vertically movably mounted on the holding element. In that case, actuation of the further adjustment device causes the vertical movement of the holding portion. The holding portion and the connecting element, with which the drawer is movable in a lateral direction, are movable independently of each other by actuation of the further adjustment device or the adjustment device.

In that respect, the further adjustment device can in principle have a similar structure to the adjustment device so that the above-mentioned advantages can also apply to the further adjustment device. Thus, positional adjustment of the drawer both in a vertical and also in a lateral direction is possible actively and with a high level of accuracy.

It is particularly preferably provided that the further adjustment device includes a rotationally movable further transmission device with which a rotational movement component can be converted to a translatory movement of the connecting element or the holding portion and thus the at least one support bar. A drawer resting on the support bar can thereby be moved vertically.

The invention further includes an extension guide fitment for a drawer comprising two extension guides to be arranged at mutually opposite sides of a drawer. In that case, the extension guide fitment includes an extension guide as described above, which is to be arranged at a first side of the drawer. A second extension guide to be arranged at the opposite side of the drawer includes a second holding element with a second connecting element. The second holding element is or can be connected to the second extension rail. The drawer can be connected to the extension rail of the second extension guide with the second connecting element.

According to the invention, the second connecting element for adaptation to the relative positional displacement of the holding element and the connecting element of the first extension guide when the drawer is mounted in place are movable relative to each other. The second connecting element is mounted floatingly on the second holding element and can follow the relative displacement of the connecting element on the holding element of the first extension guide if a drawer is connected with the connecting element and the second connecting element to the extension rails of the first and second extension guides. In that respect, the floating support is preferably limited to the horizontal movement of the second connecting element. In other words, the second connecting element is mounted floatingly in the horizontal direction while fixing of the second connecting element can be provided in the vertical direction. Floating support, however, is also conceivable both in the horizontal and in the vertical directions.

That measure provides that only one holding element has to have an adjustment device as described hereinbefore, whereby costs can be saved.

It is particularly preferably provided in that respect that arranged on the second holding element is a second guide device, by which the second connecting element is guided displaceably for the displacement on the second holding element. In a further embodiment, the second holding element includes an arresting device, by which the second displacement element can be releasably arrested. In that respect, an arresting device can be arranged only on the second holding element, whereby the horizontal movement of the connecting element on the holding element of the first extension guide is also blocked and therefore overall lateral displacement of the drawer relative to the extension rail is prevented.

As stated above, the floating support for the second connecting element on the second holding element, such support permitting a movement of the second connecting element, that follows the displacement of the connecting element on the holding element, can be limited to horizontal mobility. Particularly in that case, in a further embodiment of the invention, a further adjustment device for vertical displacement of the drawer is arranged on the second holding element. That further adjustment device can be of the same structure as the further adjustment device on the holding element of the first extension guide. If the floating mounting refers only to the horizontal direction, the vertical position of the second connecting element on the second holding element is admittedly not supported floatingly but displaceably, the further adjustment device being provided for the displacement effect. Both for the further adjustment device on the second holding element and also for the further adjustment device on the holding element, they can be self-locking so that the set position cannot be independently adjusted. Both side walls of the mounted drawer are vertically displaceable by the same amount by a further adjustment device also on the second holding element.

The invention further concerns an extension guide fitment for a drawer, including a first extension guide with a first fixing element and a second extension guide with a second fixing element. The first extension guide can be connected to the drawer with the first fixing element. The second extension guide can be connected to the drawer with the second fixing element. The two extension guides are arranged at mutually opposite sides of a furniture carcass. A first fixing element is movably mounted in or on an adjusting element arranged at the first extension guide, wherein that adjusting element serves for displacement of the drawer in a lateral direction relative to the first extension guide. In other words, a movement of the adjusting element is converted to a relative movement of the drawer with respect to the first extension guide in a lateral direction and vice-versa. In that respect, the movement of the adjusting element can include a rotary movement or also a pivotal movement about a vertical axis. It will be appreciated that other forms of movement are also conceivable.

Such an adjusting element easily permits lateral displacement of the drawer relative to the first extension guide, for example to correct the installation position of a drawer which is slightly inclinedly installed. One-sided relative displacement, however, can have the result that the drawer becomes jammed in the furniture carcass and an extension movement is no longer possible at all.

To counteract that problem, arranged on the second extension guide is a mounting portion, in which the second fixing element is mounted movably for adaptation to the displacement of the drawer relative to the first extension guide. Thus, the drawer is movable in a lateral direction not only relative to the first extension guide but also relative to the second extension guide. In that case, the second fixing element is mounted floatingly in the mounting portion so that the drawer can follow the displacement movement by the adjusting element also at the side of the second extension guide.

It is preferably provided in that respect that the first fixing element is arranged in the front half of the first extension guide, in particular the extension rail of the first extension guide. Additionally or alternatively, the second fixing element can be arranged in the front half of the second extension guide, in particular the extension rail of the second extension guide. In that respect, the front half of the extension guide refers to the region of the front panel of the drawer in the direction of the rear wall of the drawer.

In that case, the first and second extension guides each have a carcass rail and an extension rail. A central rail can be arranged between the carcass rail and the extension rail, the central rail making it possible to allow the drawer to be pulled fully out. In that case, the first and second fixing elements can be arranged on the extension rails of the first and second extension guides.

Besides the first and second fixing element with the adjusting element and the mounting portion, arranged in the rear region of the drawer can be a holding element and a second holding element which as described above are adapted for lateral displacement of the drawer relative to the extension guides or for following that movement. It is thus possible for the entire drawer to be displaced in as parallel a relationship as possible, that is to say in the front and the rear regions, in the lateral direction, whereby any risk of jamming due to an inclined drawer is further minimized.

To permit a kind of connection between the drawer and the first and second extension guides, that is as simple as possible, an embodiment of the invention provides that the first fixing element and additionally or alternatively the second fixing element includes a push-in projection which is fitted into openings in the drawer bottom or in the side walls of the drawer. In that case, the push-in projection can have latching elements with which the connection to the drawer is improved.

In a further embodiment, the first adjusting element includes a latching device, with which the first fixing element is in latching engagement. That prevents an independent return movement after a lateral displacement of the drawer due to the latching engagement. The adjusting element however can also have a self-locking action based on frictional engagement for preventing an independent return motion. In addition, that makes it possible to provide for discrete lateral displacement.

The invention further concerns a drawer with at least one extension guide as described hereinbefore or an extension guide fitment as described hereinbefore.

The invention further concerns an article of furniture with at least one such drawer.

BRIEF DESCRIPTION OF THE DRAWINGS

Further details and advantages of the present invention are described more fully hereinafter by means of the specific description with reference to the drawings in which.

DETAILED DESCRIPTION OF THE INVENTION

Figure 1:
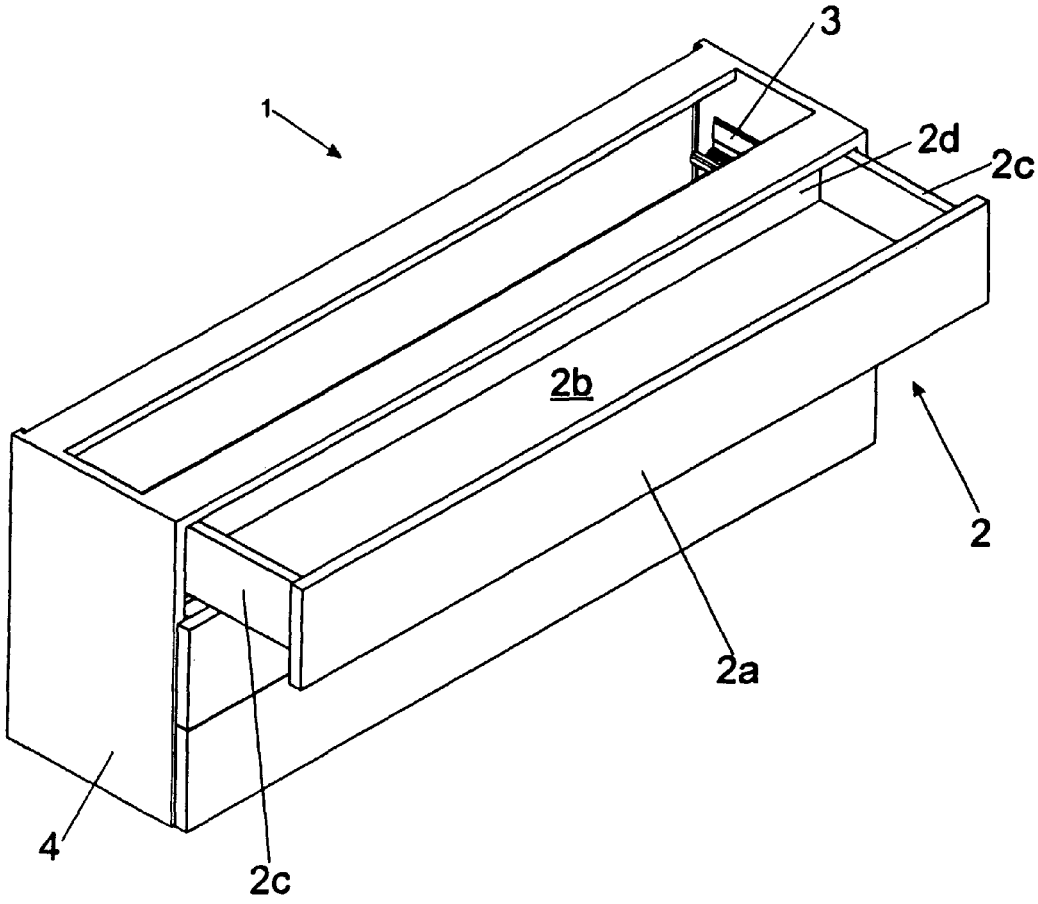
FIG. 1 shows a partly broken-away perspective view of an article of furniture according to the invention.

The partly broken-away perspective view in FIG. 1 shows an article of furniture 1 with a plurality of extendable drawers 2 which are arranged in a furniture carcass 4 and which are mounted in the furniture carcass 4 by way of two respective extension guides 3, 3' arranged at opposite sides of the furniture carcass 4. The extension guides 3, 3' are arranged on mutually opposite side walls 2*c* of the drawer 2. At its front side, the drawer 2 has a front panel 2*a* and at its rear side it has a rear wall 2*d*. The drawer bottom 2*b* is arranged therebetween.

Figure 2A:
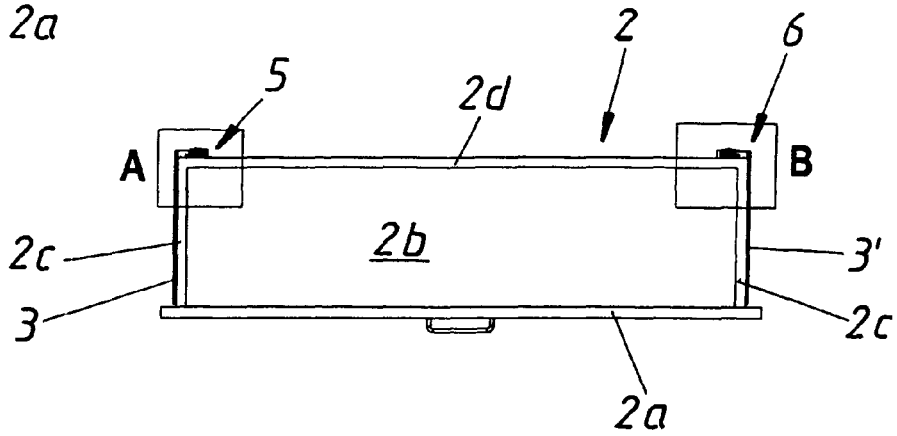
FIGS. 2*a* through 2*c* show a plan view of a drawer with an extension guide fitment and two detail views.

FIG. 2*a* shows a plan view of a drawer 2 with a respective extension guide 3, 3' at mutually opposite side walls 2*c*. The extension guides 3, 3' are fixed in the furniture carcass 4, the furniture carcass 4 not being shown for the sake of enhanced clarity of the drawing. A holding element 5 which is fixed to the rear wall 2*b* of the drawer is arranged at the rear end on an extension rail 3*a*, arranged on a side wall 2*c*, of a first extension guide 3. Arranged at the rear end of the extension rail 3*d* of the opposite extension guide 3' is a second holding element 6 which is also fixed to the rear wall 2*b* of the drawer.

Figure 2B:
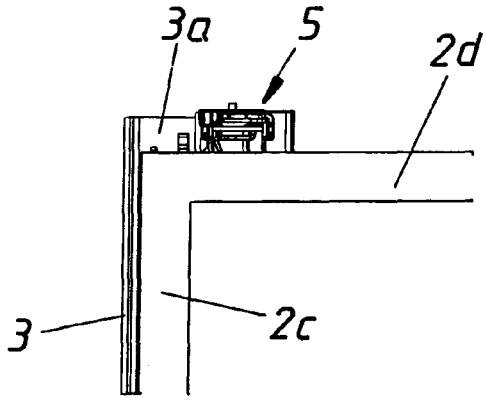
Figure 2C:
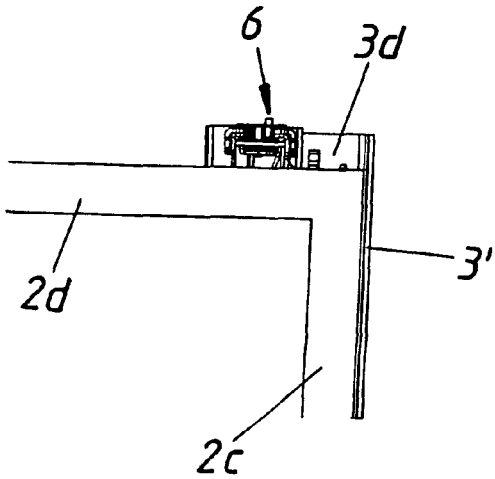

FIG. 2*b* shows a detail view of the portion marked with A in FIG. 2*a*. FIG. 2*c* shows a detail view of the portion marked with B in FIG. 2*a*. It will be seen that the first holding element 5 is connected to the extension rail 3*a* of the first extension guide 3, and the second holding element 6 is connected to the extension rail 3*d* of the second extension guide 3'. The holding elements 5, 6 are also connected to the rear wall 2*b* of the drawer.

Figure 3A:
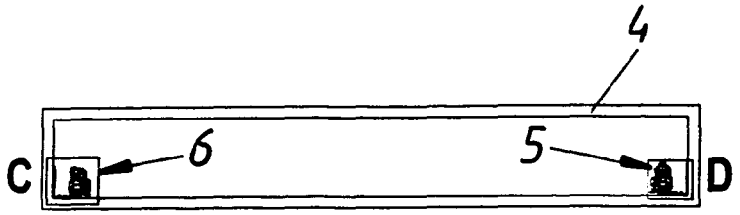
FIGS. 3*a* through 3*c* show a front view of a drawer with an extension guide fitment according to the invention and two detail views.
Figure 3B:
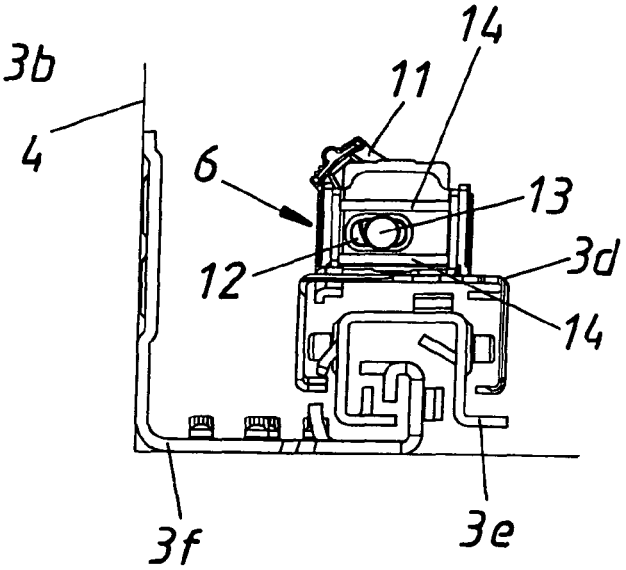
Figure 3C:
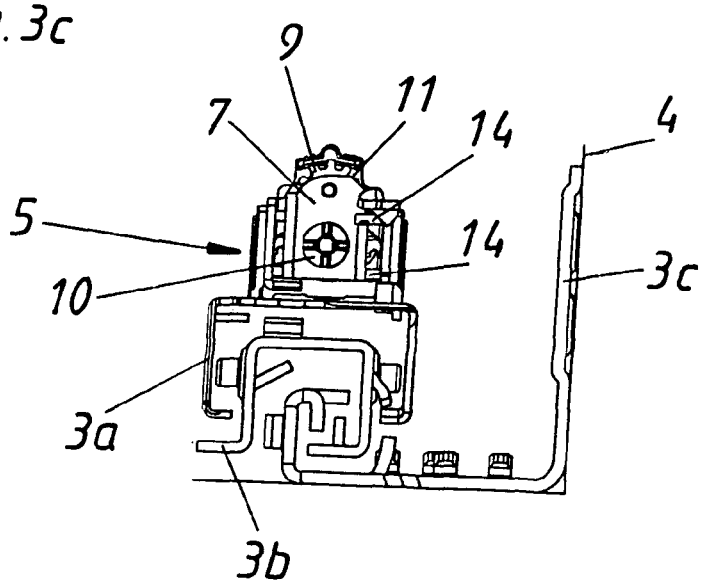

FIGS. 3*a* through 3*c* show a front view of the arrangement of FIGS. 2*a* through 2*c*, the drawer 2 not being shown for the sake of clarity. In that respect, it will be seen from FIG. 3*a* that the first holding element 5 and the second holding element 6 are each arranged in the lower region of the drawer rear wall 2*b*. The furniture carcass 4 is shown in this view, in which respect only one extendable drawer 2 is arranged in the furniture carcass 4 in the illustrated case.

FIG. 3*b* shows a front view of a second holding element 6 arranged on an extension rail 3*d* of the second extension guide 3'. The second holding element 6 can be, for example, welded to the extension rail 3*d*. The second extension guide 3' further has a carcass rail 3*f* fixed to the furniture carcass 4. A central rail 3*e* is arranged between the carcass rail 3*f* and the extension rail 3*d*, thereby permitting the drawer 2 to be pulled fully out.

A second adjustment device 11 which can be actuated by way of a handle without using a tool allows for vertical movement of the drawer 2 relative to the extension guide 3'. In that arrangement, the second adjustment device 11 is mounted pivotably in a slot 12 by a pin 13. A second connecting element 8 (which is not shown in this Figure for the sake of clarity, and by means of which the second holding element 6 is connected to the drawer 2) is mounted floatingly in the lateral direction on the guide pins and is thereby fixed in a vertical direction. In that way, it is possible to follow the lateral movements of the first connecting element 7 mounted at the opposite side. The second connecting element 8 has substantially the same structure as the connecting element 7.

FIG. 3*c* shows a front view of the first holding element 5. The first connecting element 7 is guided displaceably by the guide pins 14 so that the connecting element 7 can be moved by guide grooves along the guide pins 14 relative to the first holding element 5. The holding element 5 is connected to the drawer 2 by the connecting element 7. That connection cannot be seen in this Figure. The position of the connecting element 7 can be actively adjusted in the lateral direction by an adjusting wheel 9 of a first adjustment device, so that the drawer 2 connected to the connecting element 7 can be displaced in the lateral direction relative to the extension rail 3*a* (i.e., in a direction substantially orthogonal to the extension rail 3*a* but within the same plane). Instead of the adjusting wheel 9 which is to be actuated without a tool, the adjustment device is also actuable with an adjusting screw 10 which thus also serves for moving the connecting element 7 along the guide pins 14. A second adjustment device 11 (which has substantially the same structure as in the case of the second holding element 6) serves for vertical displacement of the drawer 2.

While the floating support for the second holding element 6 in the horizontal direction means that only one adjustment device is necessary for lateral displacement of the drawer, in this embodiment second adjustment devices 11 for vertical displacement of the drawer 2 are arranged on both sides of the drawer for both the holding element 5 and on the second holding element 6.

Figure 4:
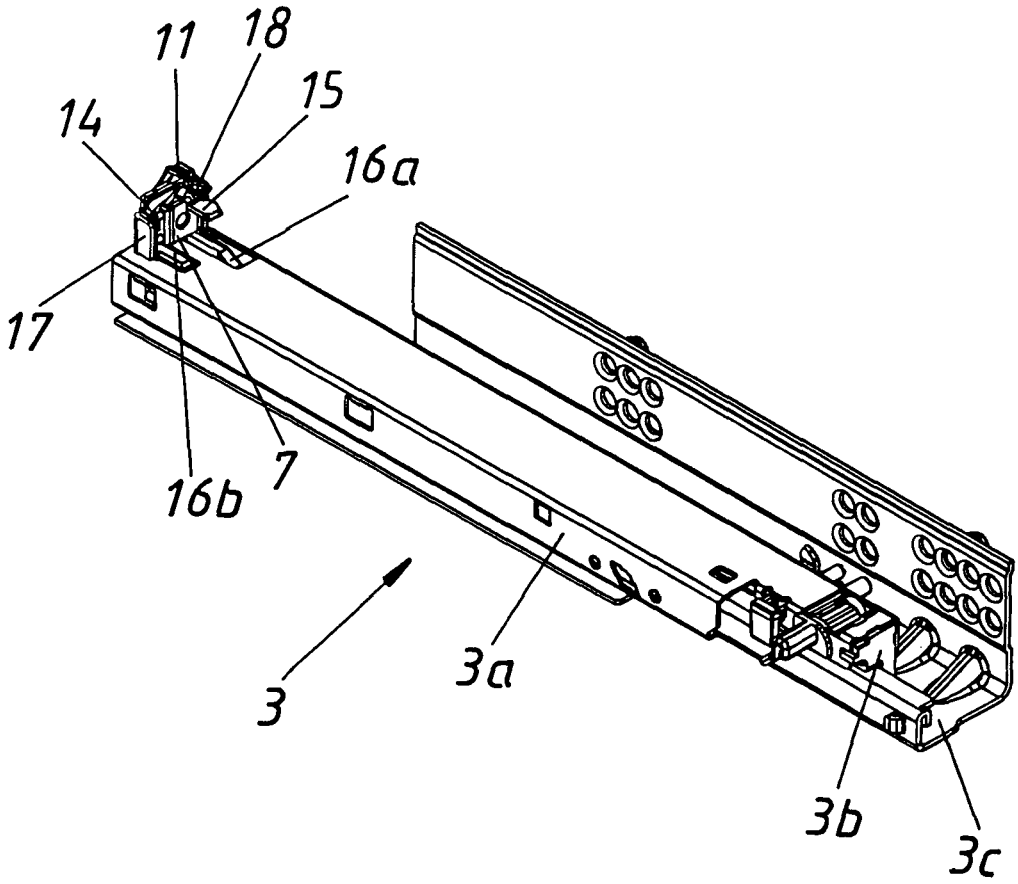
FIG. 4 shows a perspective view of an extension guide with a holding element according to the invention.

The perspective view in FIG. 4 shows a further embodiment of a holding element 5 which is fixed to an extension rail 3*a* of an extension guide 3 which, besides the extension rail 3*a*, includes a central rail 3*b* and a carcass rail 3*c*. A holding nose 15 arranged on the connecting element 7 can be fitted into pre-drilled bores in the drawer rear wall. A first adjustment device includes an adjustment lever 18. Actuation of the adjusting lever 18 causes displacement of the connecting element 7 and the holding nose 15 with the drawer 2 fixed thereto along the guide pins 14 in the lateral direction. In the mounted condition, the drawer bottom 2*b* rests on support bars 16*a* and 16*b* arranged on a holding portion 19 (see FIGS. 5*a* and 5*b*) mounted movably in a vertical direction in the first holding element 5. The support bars 16*a* and 16*b* arranged in openings 20*a*, 20*b* in the extension rail 3*a* and the drawer 2 disposed thereon can be displaced in a vertical direction relative to the extension guide 3 by actuation of the second adjustment device 11. Support elements 17 of the holding element 5 are connected fixedly, for example by welding, to the extension rail 3*a*, and serve for support purposes, in particular in respect of that vertical movement.

Figure 5A:
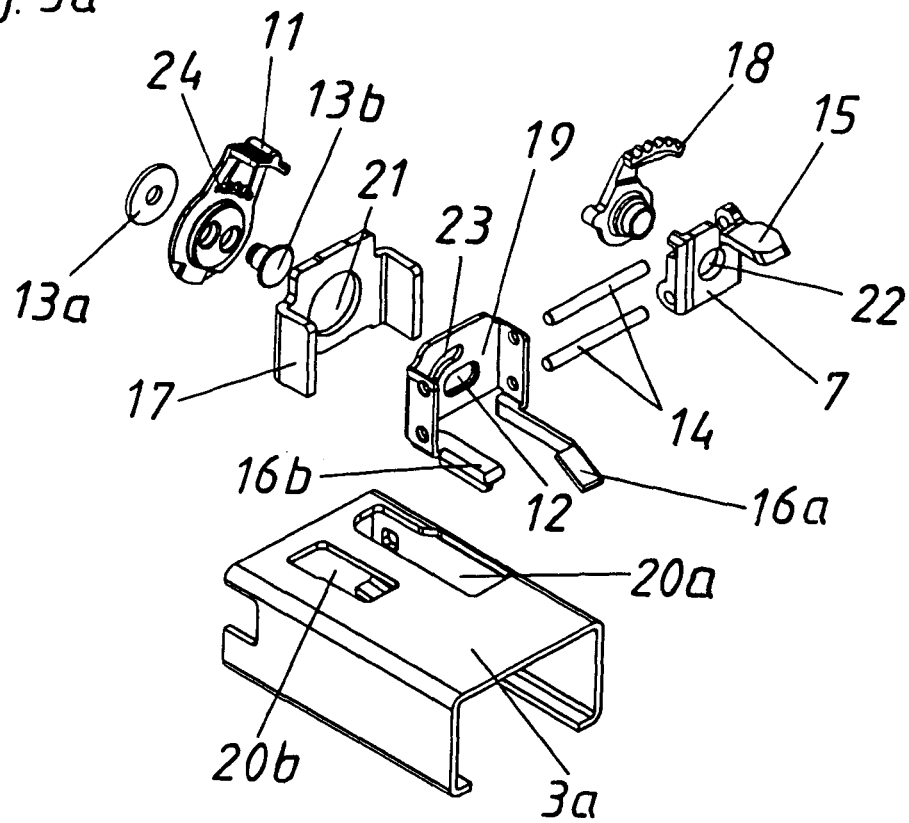
FIGS. 5*a* and 5*b* show an exploded view and a perspective view of a portion of the extension rail with the holding element.

FIG. 5*a* shows an exploded view of the holding element 5 in FIG. 4. It will be noted, however, that only a part of the extension rail 3*a* is shown. The support element 17 is connected to the extension rail 3*a*. A holding portion 19 is mounted in the support element 17 displaceably in a vertical direction in perpendicular relationship to the longitudinal direction of the extension rail 3*a*. So that this vertical direction of movement is possible, arranged in the extension rail 3*a* are openings 20*a* and 20*b* into which the support bars 16*a* and 16*b* are movable. The second adjustment device 11, which is in the form of an adjusting lever, is pivotably mounted in a slot 12 of holding portion 19 and a through hole 21 by a two-part bearing journal 13*a*, 13*b*. The latching elements 24 are in engagement with a sliding guide 23 in holding portion 19 so that a pivotal movement of the further adjustment device 11 involves a vertical movement of the holding portion 19 relative to the extension rail 3*a* and to the support element 17. The rotational movement of the adjusting lever of the second adjustment device 11, which is part of a transmission device, is converted to the vertical movement of the holding portion 19. As the drawer bottom 2*b* at least partially rests on the support bars 16*a*, 16*b* when the drawer is in the mounted condition, the vertical movement of the holding portion 19 is transmitted to the drawer 2.

The first adjustment device includes pins 14 mounted in the holding portion 19. The connecting element 7 is guided displaceably by those guide pins 14 by way of guide grooves arranged in the connecting element 7 and guide sleeves in the form of through holes. The adjusting lever 18 is pivotably mounted in a through hole 22. The connecting element 7 has a holding nose 15, by which the drawer is connected to the connecting element 7 and, as a further consequence, to the extension rail 3*a* by way of the holding element 5. A pivotal movement of the adjusting lever 18 is transmitted to lateral abutment surfaces on the holding element so that the connecting element 7 is displaced along the guide bars 14. In that way, the drawer 2 in the mounted condition is moved in the lateral direction relative to the extension rail 3*a*. The adjusting lever 18 is part of a rotational transmission device, the movement component of which is converted to a lateral translatory movement of the drawer.

Figure 5B:
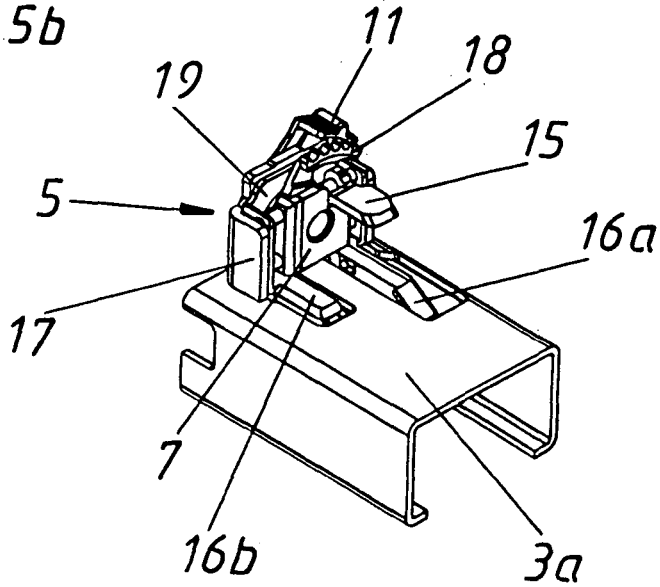

FIG. 5*b* shows the arrangement of FIG. 5*a* in the assembled condition.

Figure 6A:
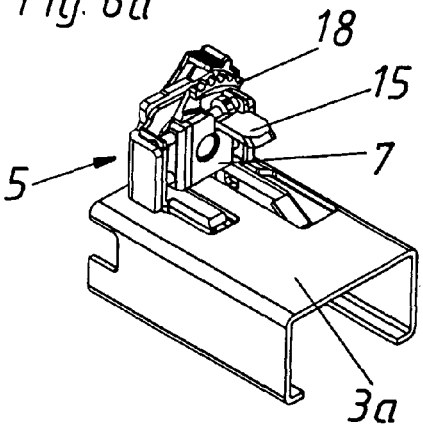
FIGS. 6*a* through 6*c* show perspective views of a portion of the extension rail with the holding element and the connecting element in various set positions.
Figure 7A:
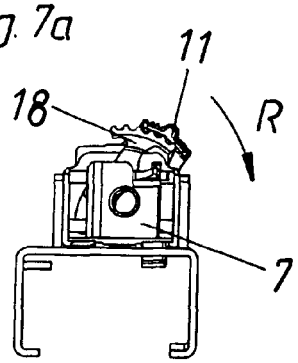
FIGS. 7*a* through 7*c* show front views of FIGS. 6*a* through 6*c*, FIGS. 8*a* and 8*b* show a perspective view and an exploded view of a further embodiment of a holding element according to the invention.
Figure 6B:
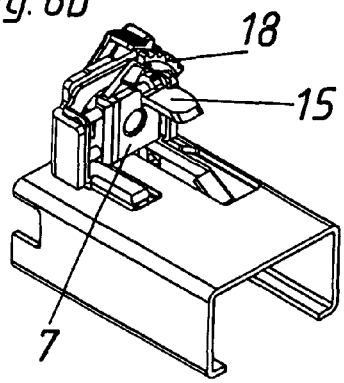
Figure 6C:
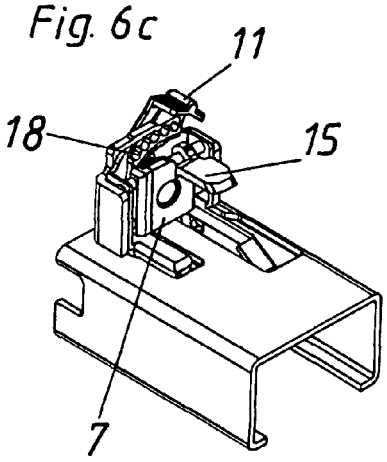

FIGS. 6*a* through 6*c* show the same arrangement as in FIG. 5*b*. However, FIGS. 6*a* through 6*c* differ in respect of the position of the connecting element 7 and the adjusting lever 18 on the holding element 5. As can be seen from the front view in FIG. 7*a*, the connecting element 7 and the adjusting lever 18 are disposed in FIG. 6*a* in a position which (viewed from the front) is slightly to the right of the center of the extension rail 3*a*.

Figure 7B:
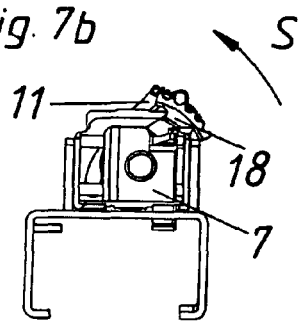
Figure 7C:
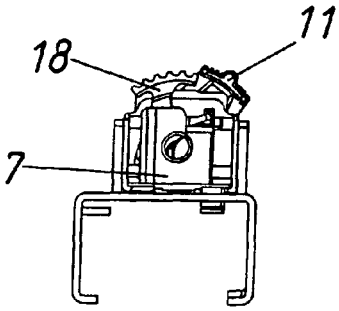

When the adjusting lever 18 is pivoted in the direction of the arrow R, the connecting element 7 moves further towards the right as viewed from the front. That is shown in FIGS. 6*b* and 7*b*. When the adjusting lever 18 is pivoted in the direction of the arrow S the connecting element 7 moves towards the left as viewed from the front, that is to say in the opposite direction. That is shown in FIGS. 6*c* and 7*c*.

Figure 8A:
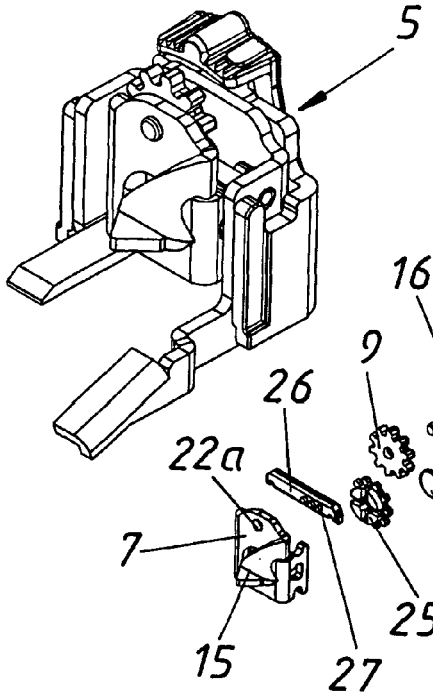
Figure 8B:
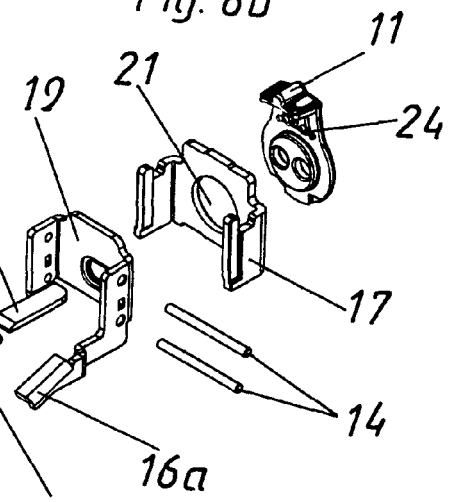

The embodiment of the first holding element 5, shown in FIGS. 2*a* through 2*c* and 3*a* through 3*c* can be seen in the perspective view of FIG. 8*a* and in the associated exploded view in FIG. 8*b*. The single substantial change in relation to the embodiments of FIGS. 4, 5*a* and 5*b* as well as FIGS. 6*a* through 6*c* and 7*a* through 7*c* relates to the first adjustment device, by which the connecting element 7 is movable horizontally in the holding element 5. The adjusting wheel 9 is in engagement with a gear 25. The adjusting wheel 9 is mounted rotatably in a through hole 22*a*. The gear 25 is mounted rotatably in the through hole 22 and has recesses, whereby actuation of the gear 25 is possible with a screwdriver. A bar member 26 has latching elements 27 which are in engagement with further recesses (not shown in detail here) on the gear 25. Rotation of the adjusting wheel 9 is firstly converted to rotation of the gear 25. Its rotations are converted to a lateral translatory movement of the connecting element 7 along the guide pins 14 by the latching elements 27 arranged in the form of the tooth configuration of a rack. The bar member 26 is mounted in the holding portion 19.

Figure 9A:
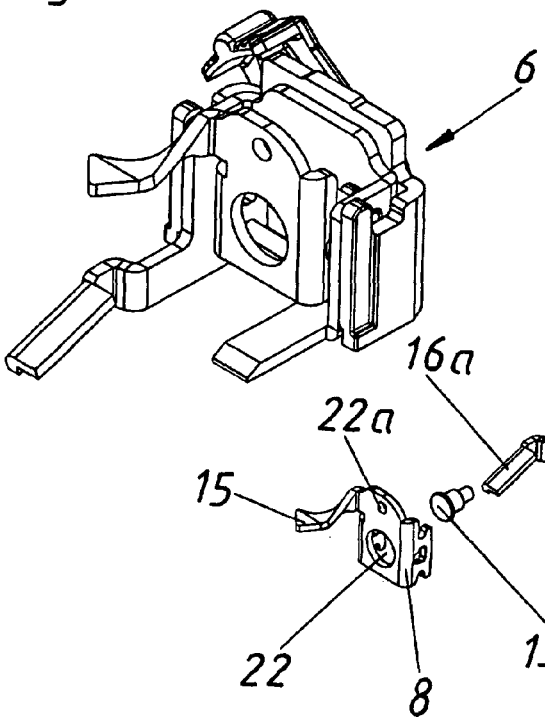
FIGS. 9*a* and 9*b* show a perspective view and an exploded view of a second holding element.
Figure 9B:
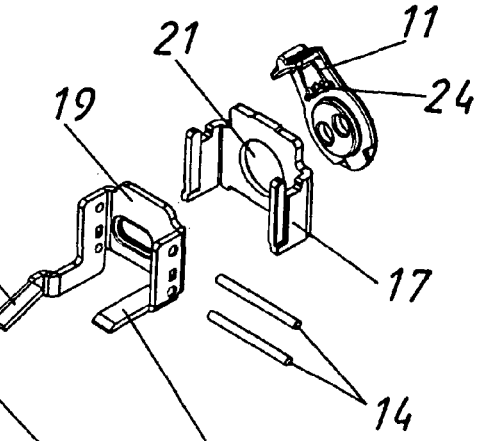

FIG. 9*a* shows a perspective view of the second holding element 6, in the embodiment illustrated in FIGS. 2*a* through 2*c* and 3*a* through 3*c*. In this case, the second holding element has the same configuration as the holding element 5 in FIGS. 8*a* and 8*b*, except for the adjustment device for the horizontal movement of the connecting element 7. In this case, the second connecting element 8 is mounted floatingly (slidably) on the guide pins 14 and can therefore follow an adjustment in respect of the lateral position of the connecting element 7. Floating support in a direction perpendicular thereto is not provided. The second adjustment device 11 for vertical displacement of the drawer 2 is also arranged in the second holding element 6.

Figure 10A:
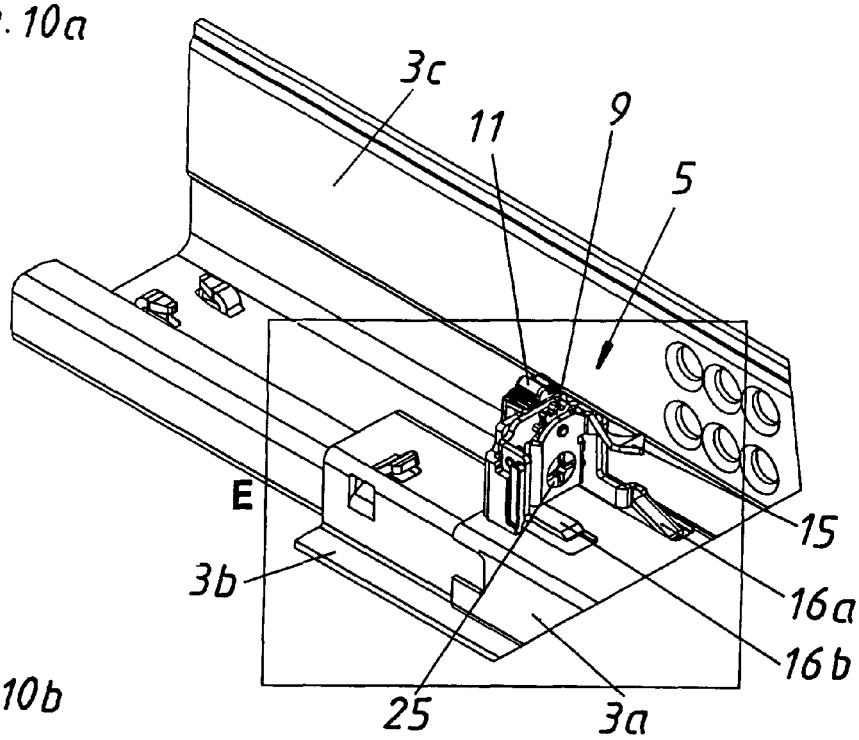
FIGS. 10*a* and 10*b* show a perspective detail view of a part of an extension guide according to the invention and a detail view.

FIG. 10*a* shows a perspective view of the holding element 5 of FIG. 8*a* on an extension guide 3 comprising an extension rail 3*a*, a central rail 3*b* and a carcass rail 3*c*.

Figure 10B:
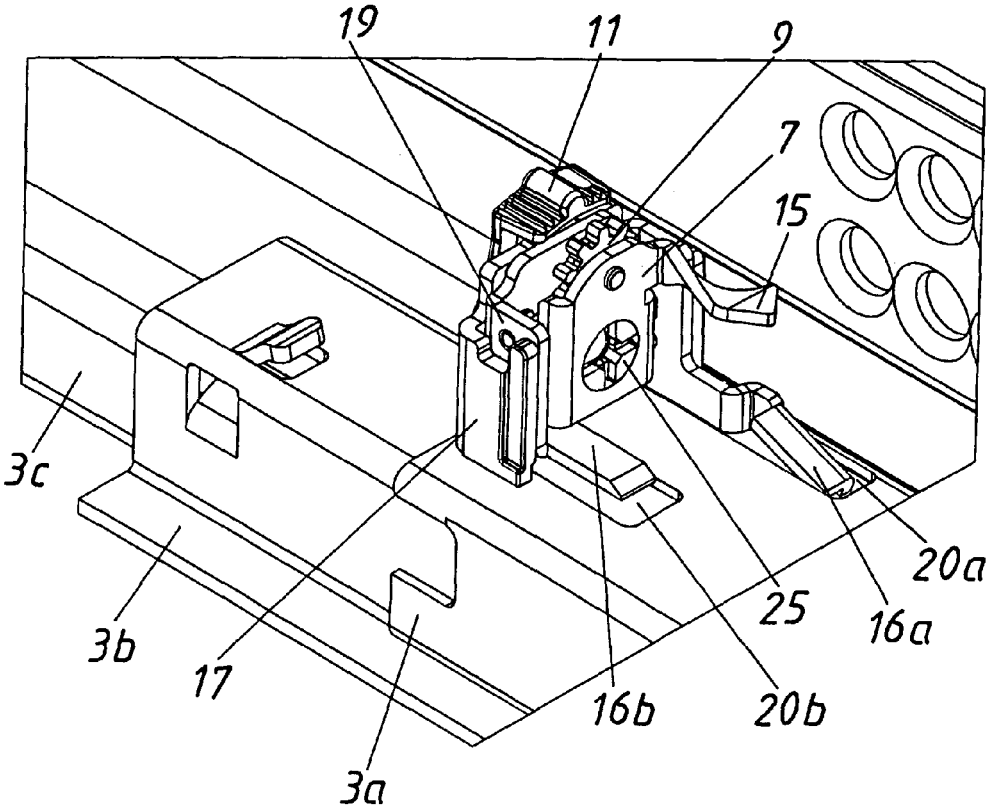

The portion marked E in FIG. 10*a* is shown as a detail view in FIG. 10*b*. The extension guide 3 is to be arranged on a first side of a drawer 2. A second holding element 6 is to be arranged on the opposite side on a second extension guide 3' which also includes an extension rail 3*d*, a central rail 3*e* and a carcass rail 3*f*. That is shown as a perspective view in FIG. 11*a*. In this case, the second holding element 6 corresponds to that in FIG. 9*a*.

Figure 11A:
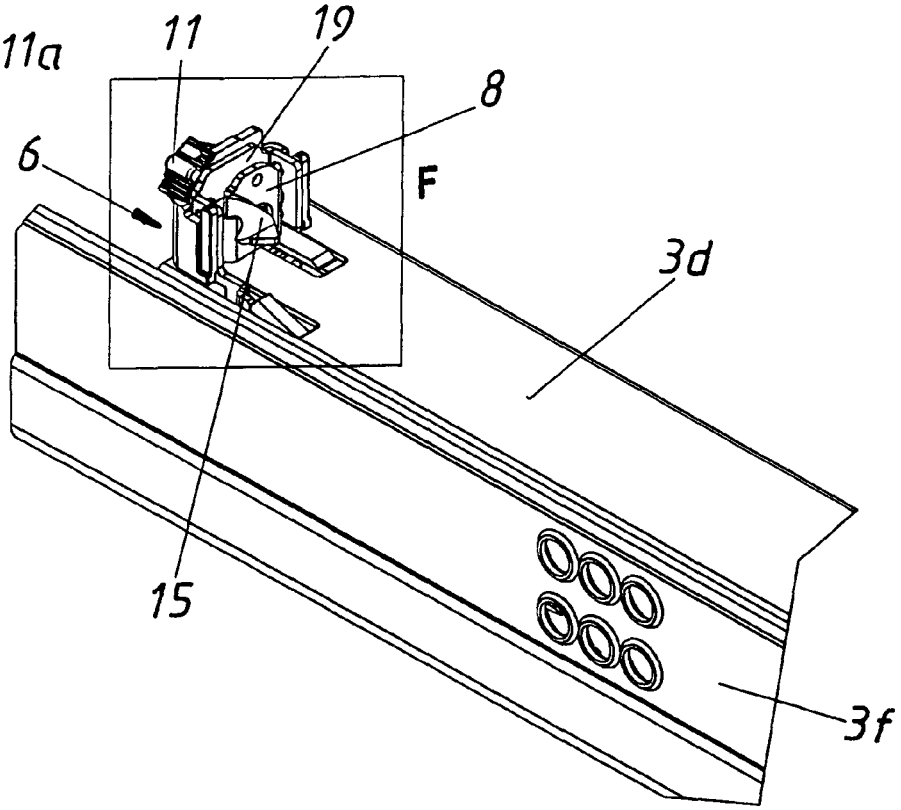
FIGS. 11*a* and 11*b* show a perspective view of a part of an extension guide with a second holding element and a detail view.
Figure 11B:
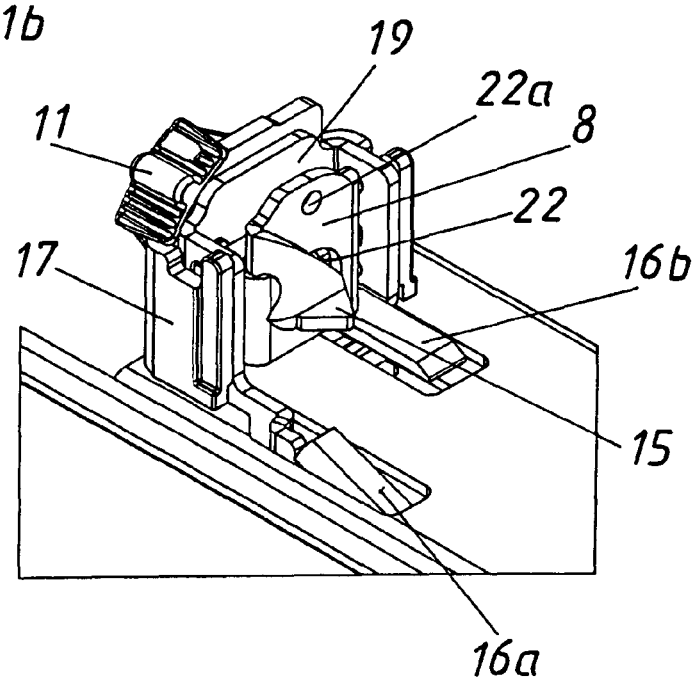

FIG. 11*b* shows a detail view of the portion marked F in FIG. 11*a*.

Figure 12A:
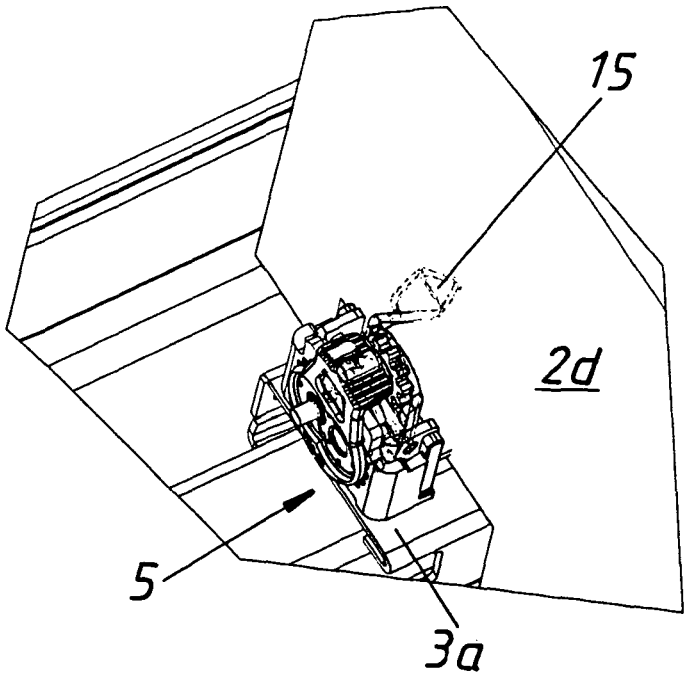
FIGS. 12*a* and 12*b* show a view of the fixing of a holding element and a second holding element in a drawer rear wall.

FIG. 12*a* shows how the holding nose 15 of the connecting element 7 is in engagement with the drawer rear wall 2*d*. In this case, the holding nose 15 is fitted into the drawer rear wall 2*b* in such a way that the drawer 2 is fixedly connected to the holding element 5. The holding nose 15 is shown in broken line and has appropriate geometrical holding surfaces.

Figure 12B:
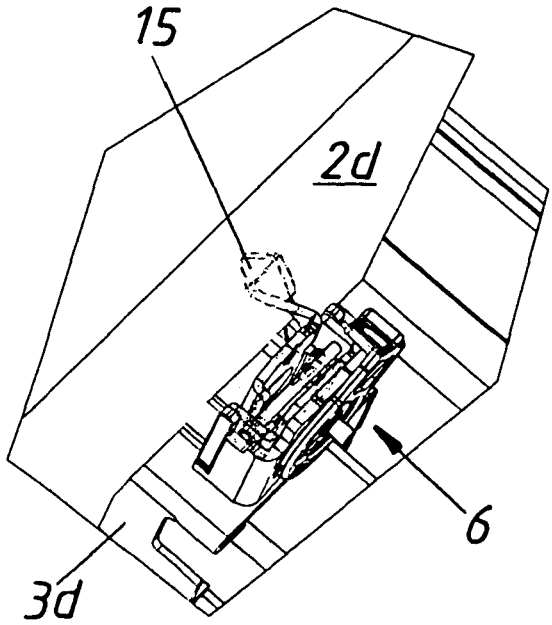

FIG. 12*b* shows how the holding nose 15 of the second connecting element 8 is in engagement with the drawer rear wall 2*d* in the region of the opposite side of the drawer 2.

Figure 13A:
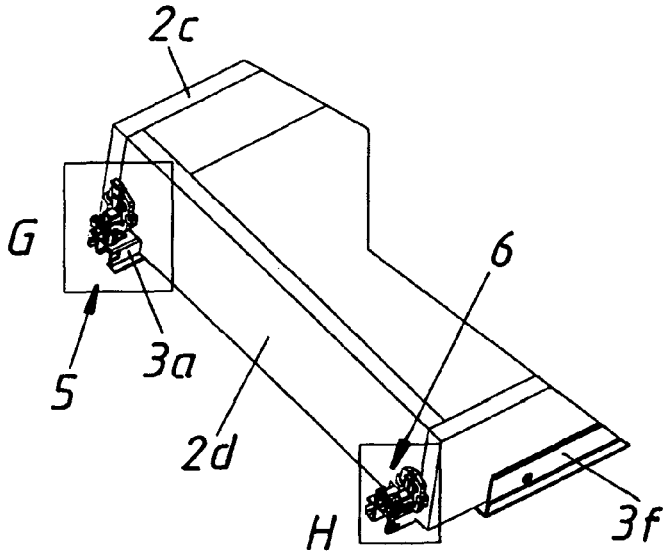
FIGS. 13*a* through 13*c* show a perspective view of a drawer with an extension guide fitment with further embodiments of a holding element and of a second holding element and detail views thereof.

FIG. 13*a* shows a perspective view of a second embodiment of a holding element 5 and a second holding element 6 which are arranged on extension rails 3*a* and 3*d*, respectively, of an extension guide 3 and 3' at opposite sides of a drawer 2 at the drawer rear wall 2*d* thereof.

Figure 13B:
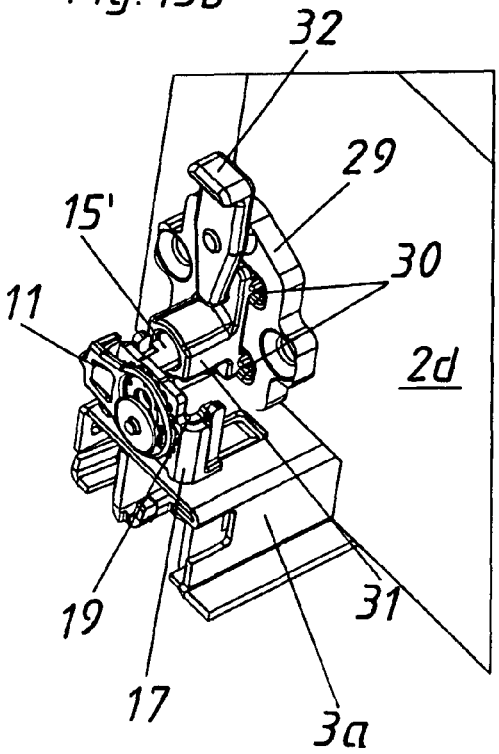

FIG. 13*b* shows a detail view of the portion marked G in FIG. 13*a*. The support element 17 and the second adjustment device 11 and the holding portion 19 are in this case designed substantially like those in the previous embodiments, wherein disposed on the holding portion 19 is a holding nose 15' fixedly connected to the holding portion 19.

The connecting element 7 includes a mounting plate 29 mounted to the drawer rear wall 2*d*. Slots 30 serve for slidably guiding a slide element 31 having an opening for receiving the holding nose 15'. The holding element 5 is connected to the connecting element 7 by that opening and to the drawer 2 by the mounting plate 29. A lever 32 which is mounted pivotably to the mounting plate 29 and which is part of a rotationally movable transmission device is in engagement with a slot 33 of the slide element 31. A pivotal movement of the lever 32 causes the slide element 31 to be displaced in the slots 30 so that the position of the drawer 2 relative to the extension rail 3*a* is displaced in the lateral direction as the slide element 31 is fixed in relation to the lateral direction by the connection to the holding nose 15'.

Instead, it would also be possible for the connecting element 7 with the holding nose 15' to be mounted displaceably in the lateral direction to the holding element 5 in the same manner as in the previous embodiments and in return for the slide element 31 to be mounted non-displaceably in the slots 30.

When the second adjustment device 11 is actuated, the holding nose 15' and therewith also the slide element 31 are moved in a vertical direction. As the holes 30 do not permit a relative movement of the slide element 31 in a vertical direction, the vertical movement is transmitted to the drawer 2.

Figure 13C:
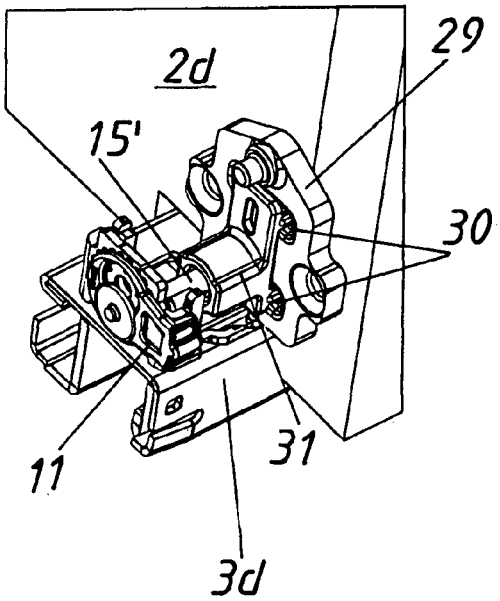

FIG. 13*c* shows a detail view of the portion marked H in FIG. 13*a*. The further embodiment shown here of the second holding element 6 has substantially the same structure as the holding element 5. All that is missing is the lever 32 for adjusting the lateral position of the drawer 2. The slide element 31 is mounted floatingly in the slots 30, due to the absence of the lever 32, so that in the event of actuation of the lever 32 on the holding element 5, displacement of the slide element 31 is effected in the slots 30 of the holding element 6 if the drawer is connected to both holding elements 5, 6.

As with the case of the holding element 5 it would also be possible for the second connecting element 8 with the holding nose 15' to be mounted displaceably in the lateral direction on the second holding element 6 in the same manner as in the previous embodiments, and in return for the slide element 31 to be mounted non-displaceably in the slots 30.

Figure 14A:
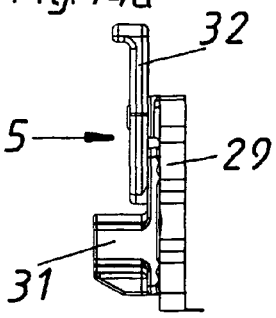
FIGS. 14*a* through 14*e* show various views and an exploded view of parts of the further embodiment of the holding element.
Figure 14B:
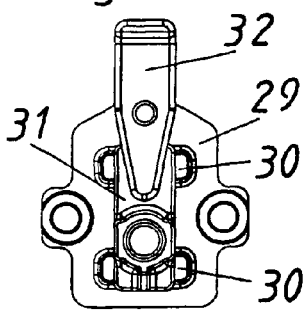
Figure 14C:
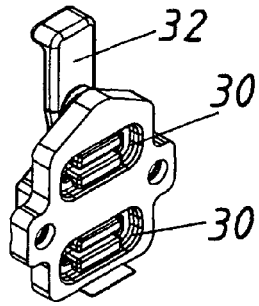
Figure 14D:
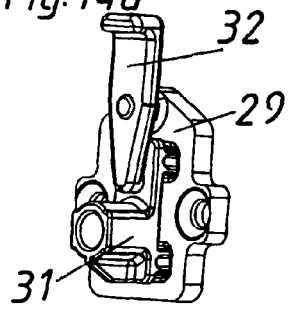
Figure 14E:
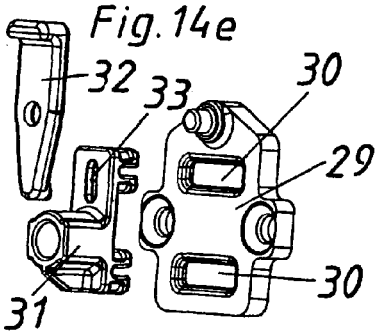

FIGS. 14*a* through 14*d* show various views of the holding element 5 in the embodiment of FIG. 13*b*. The exploded view in FIG. 14*e* shows the mounting plate 29, the slide element 31 and the lever 32.

Figure 15A:
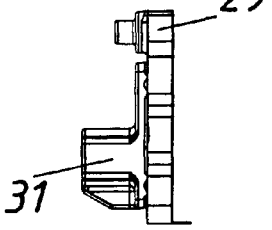
FIGS. 15*a* through 15*e* show various views and an exploded view of parts of the further embodiment of the second holding element.
Figure 15B:
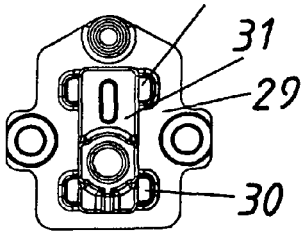
Figure 15C:
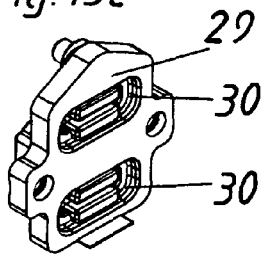
Figure 15D:
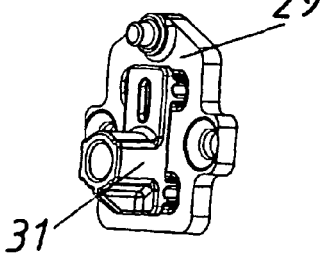
Figure 15E:
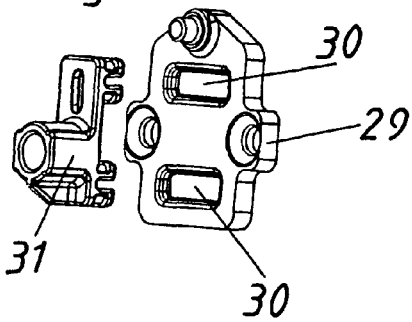

FIGS. 15*a* through 15*d* show various views of the second holding element 6 in the embodiment of FIG. 13*c*. The exploded view in FIG. 15*e* shows the mounting plate 29 and the slide element 31. The remaining components of the holding element 5 and the second holding element 6 which, except for the displaceable position of the holding noses 15, 15' of the connecting element 7 and the second connecting element 8 on the holding element 5 or on the second holding element 6, respectively, are substantially the same as in the previously described embodiments, are not shown in FIGS. 14*a* through 14*e* and 15*a* through 15*e*.

Figure 16A:
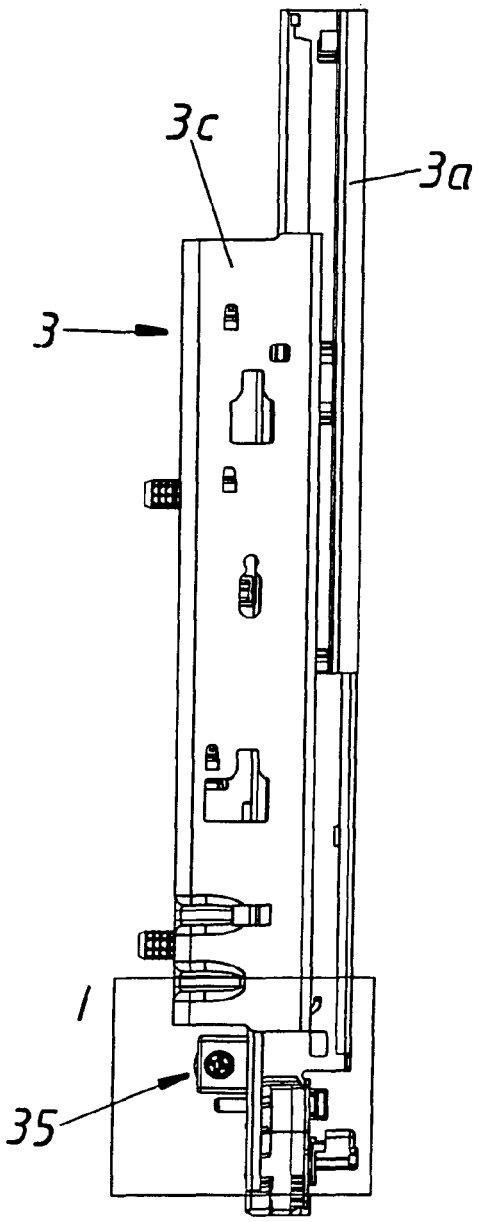
FIGS. 16*a* and 16*b* show a view of a first extension guide of an extension guide fitment according to the invention from below and a detail view.
Figure 16B:
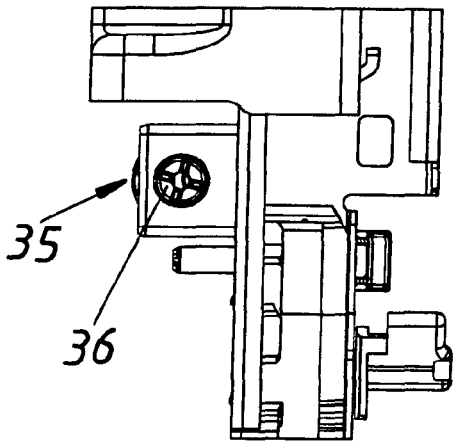

FIG. 16*a* shows a view of a first extension guide 3 and of a further extension guide 3 according to the invention comprising a carcass rail 3*c* and an extension rail 3*a*. Arranged in the front region of the extension rail 3*a* is a fixing element 34 which is displaceable in a lateral direction relative to the extension guide 3 by way of an adjusting element 35 mounted rotatably to the first extension guide 3. The adjusting element 35 can also be actuated by a screw 36. FIG. 16*b* shows a detail view of the portion marked I in FIG. 16*a*.

Figure 17A:
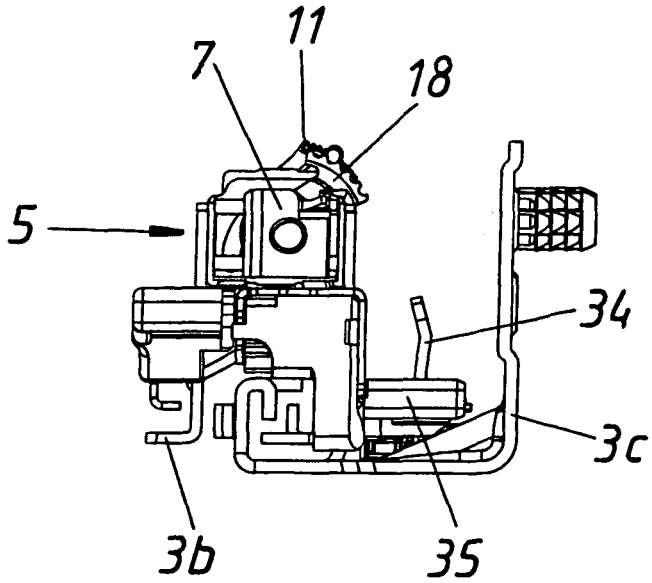
FIGS. 17*a* and 17*b* show a front view of a first extension guide of the extension guide fitment with a first fixing element in two positions.

FIG. 17*a* shows a front view of the first extension guide 3. It can be seen that arranged at the rear region of the extension rail 3*a* is a holding element 5 having a connecting element 7 movable in a lateral direction on the holding element 5. Arranged in the front region of the extension rail 3*a* is a first fixing element which includes a fixing projection 34. That fixing projection 34 is fitted in openings in the drawer bottom 2*b* or in a first side wall 2*c* of a drawer 2. The drawer is thus connected to the extension rail 3*a*. The fixing projection 34 is connected to or is mounted movably on the adjusting element 35, wherein a movement of the adjusting element 35 causes a lateral movement of the fixing projection 34 relative to the first extension guide 3 and vice-versa. The movements of the first fixing element and the adjusting element 35 are therefore coupled. Therefore, the lateral position of the drawer 2 can be altered relative to the first extension guide 3 by way of the adjusting element 35, by the connection of the fixing projection 34 to the drawer 2. In that respect, the coupling between the first fixing element and the adjusting element 35 can be in the form of an eccentric screw, a spiral disk with associated tooth arrangement or with pivot levers.

Figure 17B:
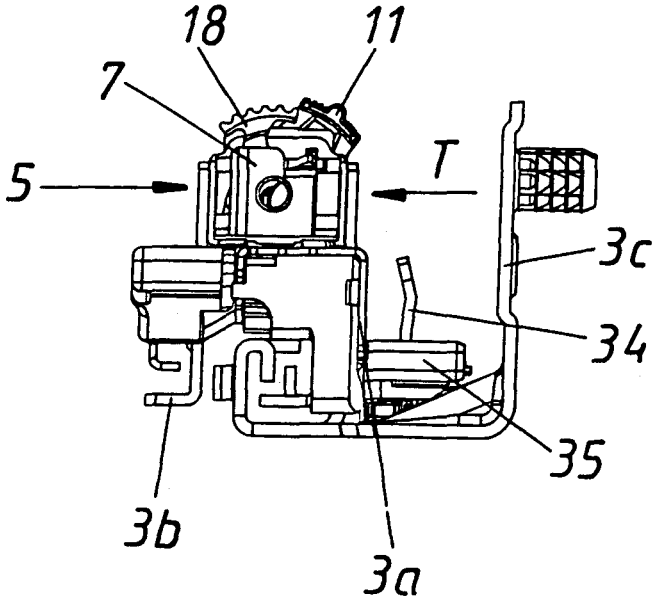

FIG. 17*b* shows the first extension guide 3 of FIG. 17*a*, wherein both the first fixing element and also the connecting element 7 of the holding element 5 have been displaced laterally in the direction of the arrow T. Because the first fixing element is provided in the front region of the extension rail 3*a* and the connecting element 7 with holding element 5 is provided in the rear region of the extension rail 3*a*, the side wall 2*c* of the drawer 2 can be laterally displaced parallel to the extension rail 3*a*.

Figure 18A:
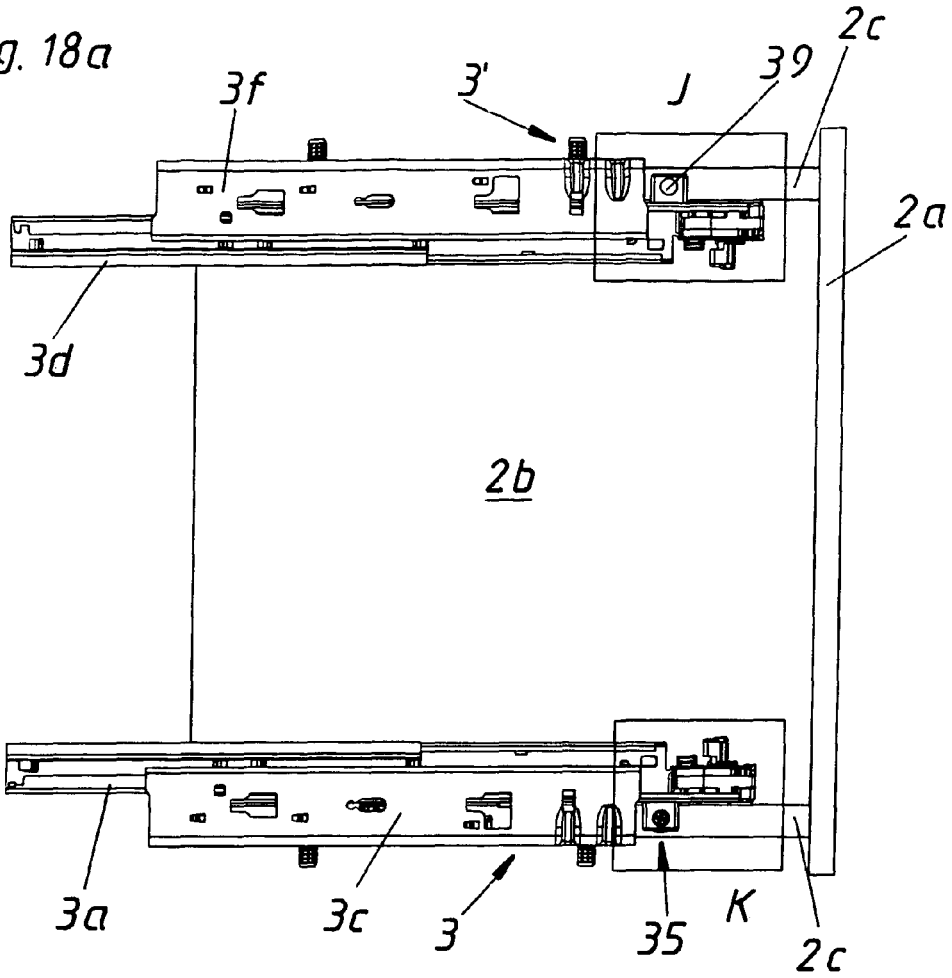
FIGS. 18*a* through 18*c* show a view of an extension guide fitment according to the invention with a connected drawer from below and two detail views.

FIG. 18*a* shows a view from below of an extension guide fitment according to the invention with connected drawer. Arranged in the rear region of the first and second extension guides 3, 3' are a first and a second holding element 5, 6 with a first and a second connecting element 7, 8. As they are arranged at the top side of the extension guides 3, 3' they are not visible in this Figure. A first fixing element with an adjusting element 35 is connected to or mounted movably on the first extension guide 3. A second fixing element which also includes a fixing projection 37 is connected to or mounted movably on a mounting portion 39 at the second extension guide 3'. The mounting portion 39 in that case is of such a configuration that active adjustment of the relative position of the drawer 2 with respect to the second extension guide 3' is not possible. Adjustment of the relative position of the drawer relative to the first extension guide 3 by means of the adjusting element 35 can however be trackingly followed so that the drawer 2 cannot assume an inclined position.

Figure 18B:
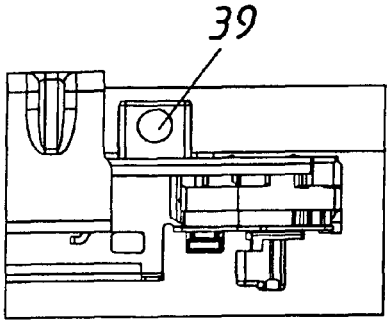

FIG. 18*b* shows a detail view of the portion marked J in FIG. 18*a* of the second extension guide 3'.

Figure 18C:
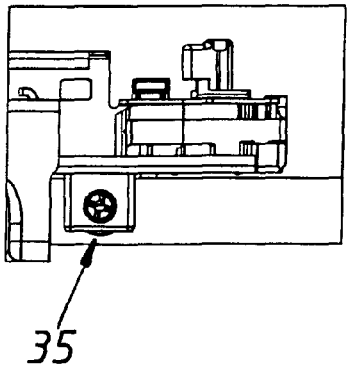

FIG. 18*c* shows a detail view of the portion marked K in FIG. 18*a* of the first extension guide 3.

Figure 19A:
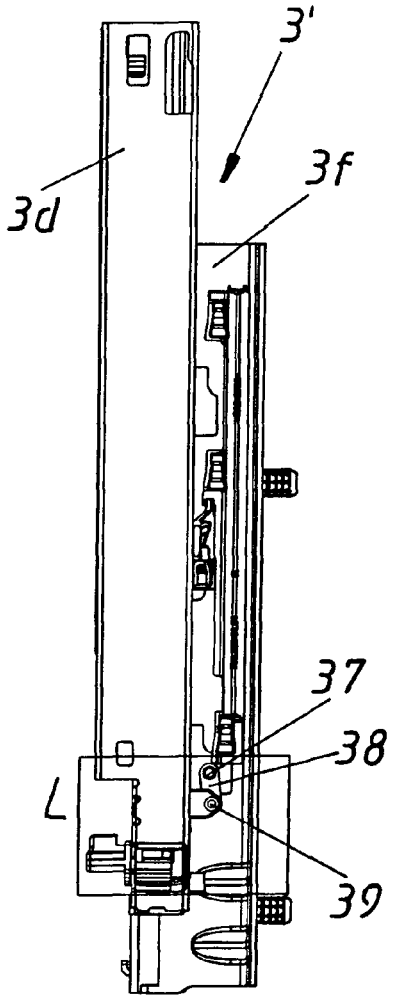
FIGS. 19*a* through 19*d* show a plan view of the second extension guide and three detail views.
Figure 19B:
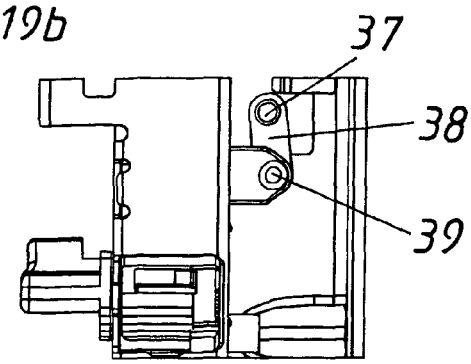
Figure 19C:
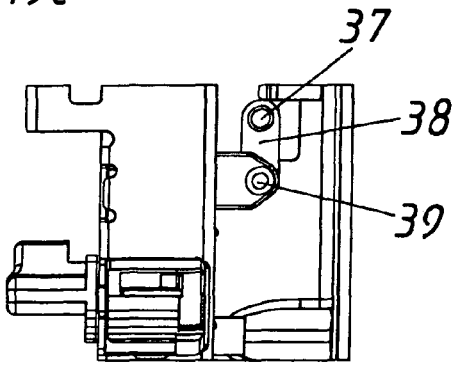
Figure 19D:
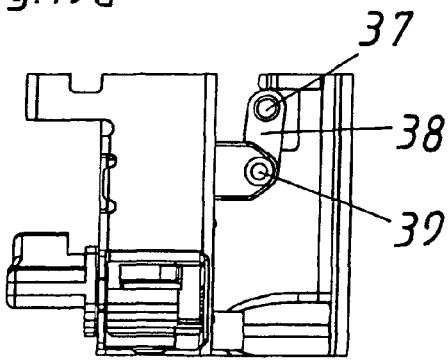

FIG. 19*a* shows a plan view of a second extension guide 3'. In this embodiment, no further holding element 6 is arranged in the rear region of the extension rail 3*d*. A mounting portion 39 in the form of a shaft is arranged in the front part of the extension rail 3*d*. A pivot lever 38 which is part of the second fixing element is mounted rotatably to that shaft. The pivot lever 38 is also preferably rotatably mounted to the fixing projection 37 which is fitted into openings provided for same in the drawer 2. The mounting of the pivot lever 38 to the mounting portion 39 is not self-locking so that displacement of the lateral position of the drawer 2 relative to the first extension guide 3 can be trackingly followed. FIGS. 19*b* through 19*d* show the portion marked L in FIG. 19*a*, wherein the position of the pivot lever 38 and, thus, of the second fixing element 37 relative to the second extension guide 3' is different.

The top side of the oppositely disposed first extension guide 3 can have a similar structure in this region. In other words, the first fixing element includes a fixing projection 34 and a pivot lever 38. It will be noted, however, that the mounting of the pivot lever to the extension rail 3*a* is not loose but self-locking and it is possibly provided with latching elements so that lateral adjustment of the drawer 2 relative to the first extension guide 3 is not independently restored by a rotary movement of the pivot lever.

The invention claimed is:

1. An extension guide for a drawer, comprising:

a carcass rail to be fixed to a furniture carcass;

an extension rail displaceable relative to said carcass rail; and a holding element connected to said extension rail, said holding element including:

a connecting element for adjustably connecting the drawer to said extension rail, said connecting element being mounted and configured so as to be movable through a horizontal plane of the drawer in a lateral direction relative to a longitudinal axis of said extension rail;

an adjustment device for laterally moving said connecting element through the horizontal plane of the drawer relative to said longitudinal axis of said extension rail, said adjustment device including a transmission device configured to rotate about an axis of rotation substantially parallel to said longitudinal axis of said extension rail, said adjustment device being configured to convert a rotational movement of said transmission device to a translatory movement of said connecting element in the lateral direction relative to the longitudinal axis of said extension rail.

2. The extension guide according to claim 1, further comprising a central rail between said extension rail and said carcass rail.

3. The extension guide according to claim 1, wherein said transmission device has a handle for actuation of said adjustment device without a tool.

4. The extension guide according to claim 1, wherein said transmission device includes a lever.

5. The extension guide according to claim 1, wherein said transmission device is actuable by a screw.

6. The extension guide according to claim 1, wherein said transmission device at least partially has an eccentric configuration.

7. The extension guide according to claim 1, wherein said holding element further includes a guide device for guiding a lateral movement of said connecting element.

8. The extension guide according to claim 7, wherein said guide device has a guide rail mounted on said holding element, and has a guide element arranged on one of said connecting element or said transmission device, said guide element being one of a guide groove or a guide sleeve at least partially encompassing said guide rail and being mounted so as to be displaceable along said guide rail.

9. The extension guide according to claim 7, wherein said guide device comprises a slot in said holding element, said connecting element having a guide projection or a guide pin mounted movably in said slot.

10. The extension guide according to claim 7, wherein said guide device comprises a sliding guide in said holding element, said connecting element having a guide projection or a guide pin mounted movably in said sliding guide.

11. The extension guide according claim 1, wherein said connecting element includes a holding nose having a horizontal portion extending parallel to said longitudinal axis of said extension rail, said horizontal portion of said holding nose being configured to extend into and engage a recess in the drawer when said holding element is connected to the drawer.

12. The extension guide according to claim 1, wherein said connecting element includes a mounting plate to be fixed to the drawer, said adjustment device being mounted to said mounting plate.

13. The extension guide according to claim 12, wherein said transmission device is mounted to said mounting plate of said connecting element so as to rotate or pivot relative to said mounting plate.

14. The extension guide according to claim 1, wherein said holding element further includes an arresting device for releasably arresting said adjustment device.

15. The extension guide according to claim 1, wherein said adjustment device is a first adjustment device, said holding element further including a second adjustment device for vertically displacing the drawer, said second adjustment device being actuable independently of said first adjustment device.

16. The extension guide according to claim 15, wherein said holding element further includes a support bar for supporting the drawer in a mounted condition, said support bar being vertically movable relative to said extension rail by said second adjustment device.

17. The extension guide according to claim 15, wherein said second adjustment device includes a rotationally movable second transmission device, said second adjustment device being configured to convert a rotational movement of said second transmission device into translatory movement of said connecting element or translatory movement of a support bar for supporting the drawer in a mounted condition.

18. An extension guide fitment for a drawer, comprising:

said extension guide according to claim 1 to be arranged at a first side of the drawer; and a second extension guide to be arranged at a second side of the drawer opposite the first side, said second extension guide including:

a second extension rail;

a second holding element connected to said second extension rail, said second holding element including a second connecting element for connecting the drawer to said second extension rail, said second connecting element being mounted movably to said second extension rail for adapting and following movement of said connecting element of said holding element of said extension guide to be arranged at the first side of the drawer.

19. The extension guide fitment according to claim 18, wherein said second holding element includes a second guide device for displaceably guiding a movement of said second connecting element of said second holding element.

20. The extension guide fitment according to claim 18, wherein said second holding element further includes an arresting device for releasably arresting said second connecting element.

21. The extension guide fitment according to claim 18, wherein said second holding element includes an adjustment device for vertically displacing the drawer.

22. An extension guide fitment for a drawer, comprising:

a first extension guide including a first fixing element for connecting said first extension guide to a container of the drawer; and a second extension guide including a second fixing element for connecting said second extension guide to the container of the drawer;

wherein said first extension guide further includes an adjusting element having a rotatable transmission device rotatable about an axis of rotation substantially parallel to a longitudinal axis of said first extension guide, said adjusting element being configured to convert a rotational movement of said transmission device to a translatory movement of said first fixing element so as to laterally displace the drawer relative to said longitudinal axis of said first extension guide through a horizontal plane of the drawer;

wherein said second extension guide further includes a mounting portion, said second fixing element being movably mounted to said mounting portion for adapting and following displacement of the drawer relative to said first extension guide by said adjusting element; and wherein at least one of said first fixing element and said second fixing element is located in a front half of a respective one of said first extension guide and said second extension guide.

23. The drawer according to claim 22, wherein said adjusting element includes a latching device in latching engagement with said first fixing element.

24. A drawer comprising:

a drawer container; and said extension guide fitment according to claim 22 attached to said drawer container.

25. An article of furniture comprising:

a furniture carcass; and a drawer according to claim 24 arranged in said furniture carcass.

26. A drawer comprising:

a drawer container including a drawer bottom and side walls attached to said drawer bottom; and an extension guide fitment attached to said drawer container, said extension guide fitment including:

a first extension guide including a first fixing element for connecting said first extension guide to the drawer; and a second extension guide including a second fixing element for connecting said second extension guide to the drawer;

wherein said first extension guide further includes an adjusting element having a rotatable transmission device rotatable about an axis of rotation substantially parallel to a longitudinal axis of said first extension guide, said adjusting element being configured to convert a rotational movement of said transmission device to a translatory movement of said first fixing element so as to laterally displace said drawer container relative to said longitudinal axis of said first extension guide through a horizontal plane of said drawer container;

wherein said second extension guide further includes a mounting portion, said second fixing element being movably mounted to said mounting portion for adapting and following displacement of said drawer container relative to said first extension guide by said adjusting element; and wherein at least one of said first fixing element and said second fixing element includes a push-in projection fitted within an opening in said drawer bottom or within an opening in said side walls of said drawer container.

27. The extension guide fitment according to claim 26, wherein said adjusting element includes a latching device in latching engagement with said first fixing element.

28. An article of furniture comprising:

a furniture carcass; and a drawer according to claim 26 arranged in said furniture carcass.

* * * * *